US010369808B2

(12) United States Patent
Manes

(10) Patent No.: US 10,369,808 B2
(45) Date of Patent: Aug. 6, 2019

(54) INKJET PRINTER

(71) Applicant: ALEPH S.R.L., Lurate Caccivio (Como) (IT)

(72) Inventor: Roberto Manes, Monza (IT)

(73) Assignee: ALEPH S.R.L., Lurate Caccivio (IT)

( * ) Notice: Subject to any disclaimer, the term of this patent is extended or adjusted under 35 U.S.C. 154(b) by 0 days.

(21) Appl. No.: 15/765,768

(22) PCT Filed: Oct. 7, 2016

(86) PCT No.: PCT/IB2016/056030

§ 371 (c)(1),
(2) Date: Apr. 4, 2018

(87) PCT Pub. No.: WO2017/060875

PCT Pub. Date: Apr. 13, 2017

(65) Prior Publication Data

US 2018/0281466 A1 Oct. 4, 2018

(30) Foreign Application Priority Data

Oct. 8, 2015 (IT) ..... 102015000059729

(51) Int. Cl.

| | |
|---|---|
| ***B41J 3/407*** | (2006.01) |
| ***B41J 11/00*** | (2006.01) |
| ***B41J 15/04*** | (2006.01) |
| ***B41J 2/01*** | (2006.01) |
| ***D06P 5/30*** | (2006.01) |

(52) U.S. Cl.

CPC ..... *B41J 3/4078* (2013.01); *B41J 2/01* (2013.01); *B41J 11/0085* (2013.01); *B41J 15/048* (2013.01); *D06P 5/30* (2013.01)

(58) Field of Classification Search

CPC ..... B41J 3/4078; B41J 11/0085; B41J 2/01
USPC ..... 347/101, 103, 104
See application file for complete search history.

(56) References Cited

U.S. PATENT DOCUMENTS

| | | | | |
|---|---|---|---|---|
| 6,068,374 | A | 5/2000 | Kurata et al. | |
| 6,315,404 | B1 | 11/2001 | Wotton et al. | |
| 6,454,478 | B2 | 9/2002 | Wotton et al. | |
| 6,672,720 | B2 * | 1/2004 | Smith | B41J 11/007 271/197 |
| 8,419,180 | B2 * | 4/2013 | Ishii | B41J 11/0065 347/104 |
| 2001/0028380 | A1 | 10/2001 | Wotton et al. | |

(Continued)

FOREIGN PATENT DOCUMENTS

| | | |
|---|---|---|
| EP | 0666180 A2 | 8/1995 |
| GB | 2357463 A | 6/2001 |

(Continued)

*Primary Examiner* — An H Do
(74) *Attorney, Agent, or Firm* — Pearne & Gordon LLP

(57) ABSTRACT

Inkjet printer (1) operable to print a print substrate made of textile, paper or plastic material, or the like, and provided with a sliding transfer surface (10) to feed the print substrate (2) in a feed direction (9); a printing device (17) arranged above the transfer surface (10) to define, on the transfer surface (10), a printing station (19); suction means (20) arranged below the transfer surface (10) to maintain the print substrate adhering to and stationary with respect to the transfer surface (10) during sliding; and an adjustment assembly to adjust planarity of the transfer surface (10).

10 Claims, 7 Drawing Sheets

(56) References Cited

U.S. PATENT DOCUMENTS

| | | | |
|---|---|---|---|
| 2004/0017456 | A1 | 1/2004 | Obertegger et al. |
| 2004/0201168 | A1 | 10/2004 | Greive |
| 2006/0132573 | A1 | 6/2006 | Nishida |
| 2013/0240593 | A1 | 9/2013 | Maeyama |
| 2017/0239959 | A1 | 8/2017 | Sanchis Estruch et al. |
| 2018/0281466 | A1 | 10/2018 | Manes |

FOREIGN PATENT DOCUMENTS

| | | | |
|---|---|---|---|
| WO | 0222362 | A2 | 3/2002 |
| WO | 2015185085 | A1 | 12/2015 |
| WO | 2017060875 | A1 | 4/2017 |

* cited by examiner

INKJET PRINTER

TECHNICAL FIELD OF THE INVENTION

The present invention relates to an inkjet printer.

In particular, the present invention relates to an inkjet printer operable to print a print substrate made of textile, paper or plastic material, or the like, and comprising a sliding transfer surface to feed the print substrate in a given feed direction, a printing device arranged above the transfer surface to define, on the transfer surface, a printing station, and suction means arranged below the transfer surface to maintain the print substrate adhering to and stationary with respect to the transfer surface during sliding.

PRIOR ART

Above-described inkjet printers are widely used in the textile and graphics industries to print large format substrates, such as banners, posters, bill-boards, canvas, furnishing fabrics, etc.

Such print substrates are usually fed to the printer in the form of flat sheets or, in the case of flexible print substrates, in the form of a roll that is unwound and then rewound after leaving the printer. In both cases, but especially in the case of flexible print substrates, holding the print substrate stationary on the transfer surface as it moves through the printing station is essential in order to achieve good quality printing.

For that purpose, the suction means have been used in the prior art to apply a relatively strong and substantially uniform suction force to the print substrate for its entire passage through the printer.

In order to maximise efficiency of the suction means, it is also known to "mask" the transfer surface by partializing suction according to the form of the print substrate, i.e., activating the suction means only in those areas of the transfer surface that are actually occupied by the print substrate.

Although the use of the above-described suction means is effective and reliable, in practice it has been found that, in some cases, especially when the print substrate has low tensile strength when wet, it is extremely difficult to combine the need for the suction force to be high enough to hold the material in place on the transfer surface and, at the same time, gentle enough not to affect the structure of the print substrate when the latter is wet with ink, causing formation of permanent depressions or ridges.

A solution to this problem has been found by differentiating suction along the feed direction, so that the suction applied on the print substrate in the printing station is lower than the suction applied upstream from the printing station.

A further problem with traditional inkjet printers and which may undermine the quality of the print is maintaining a correct planarity of the transfer surface and, as a consequence, of the print substrate adhering thereto. Owing to the suction, the transfer surface, which normally consists of a flexible belt that slides on a perforated support sheet, may tend to bend downwards and cause unevenness on the surface of the print substrate which may result in defects in the print.

Of course, this problem may occur on the entire transfer surface on which suction is applied, but it is much more evident in the parts of the transfer surface that are subject to higher suction forces, such as, in the case of differentiated suction, in the part of the transfer surface arranged upstream from the printing station.

OBJECT OF THE INVENTION

The aim of the present invention is to provide an above-described inkjet printer that overcomes the above-described drawbacks and is, at the same time, simple and economical to produce.

According to the present invention, there is provided an inkjet printer as claimed in claim 1 and, preferably, in any one of the claims directly or indirectly depending on claim 1.

BRIEF DESCRIPTION OF DRAWINGS

The present invention will now be described with reference to the accompanying drawings, illustrating a non-limiting embodiment thereof, in which.

PREFERRED EMBODIMENT OF THE INVENTION

Figure 1:
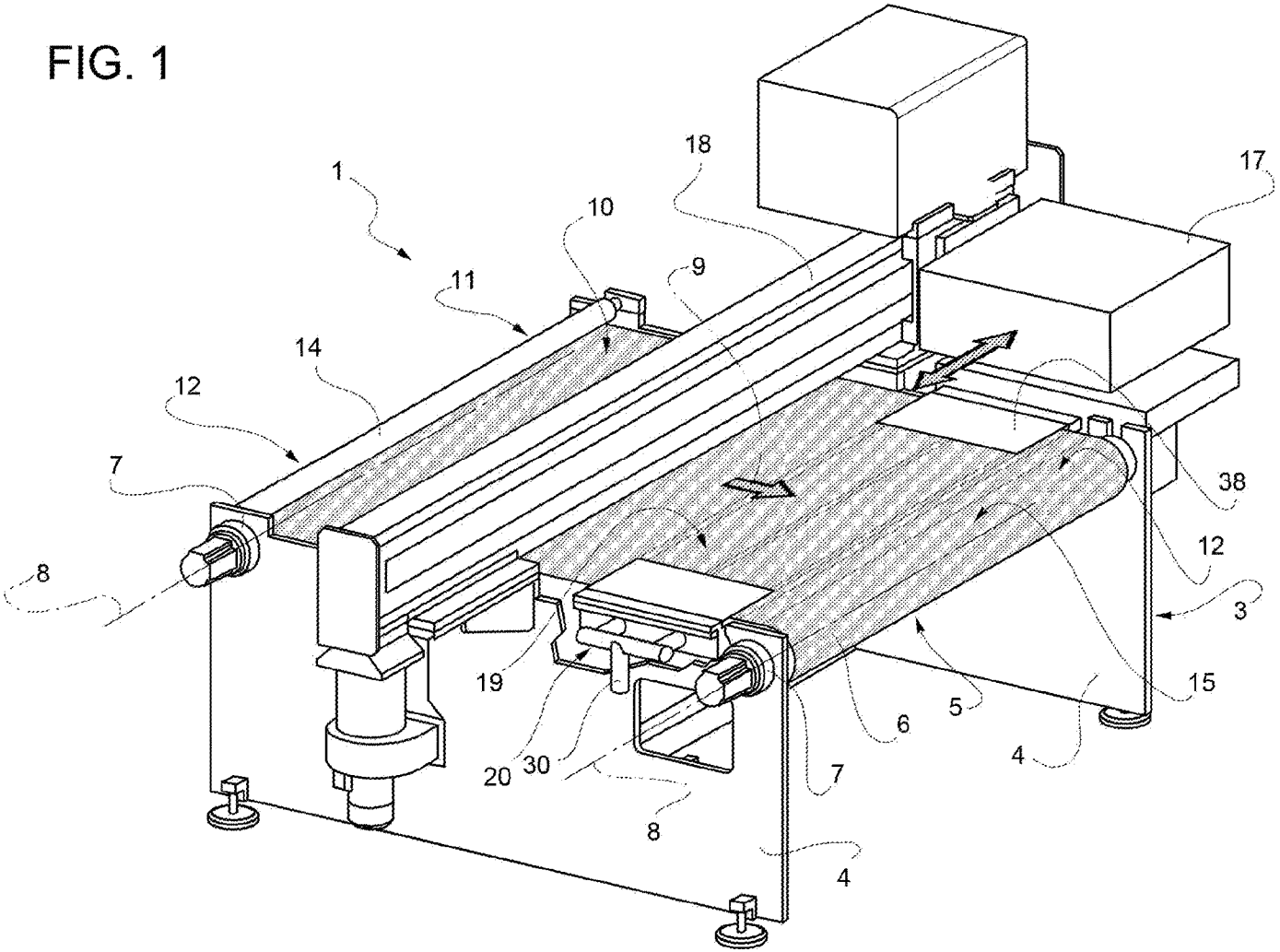
FIG. 1 is a perspective view, with parts removed for the sake of clarity, of a preferred embodiment of the inkjet printer according to the present invention.

In FIG. 1, denoted as a whole by reference numeral 1 is an inkjet printer, which is suitable to print a large format print substrate 2 made of textile, paper or plastic material, or the like, and has a so-called "movable print substrate" architecture, in which the print substrate is fed longitudinally below a printing head that moves with an alternating motion in a crosswise direction in relation to the print substrate.

Figure 2:
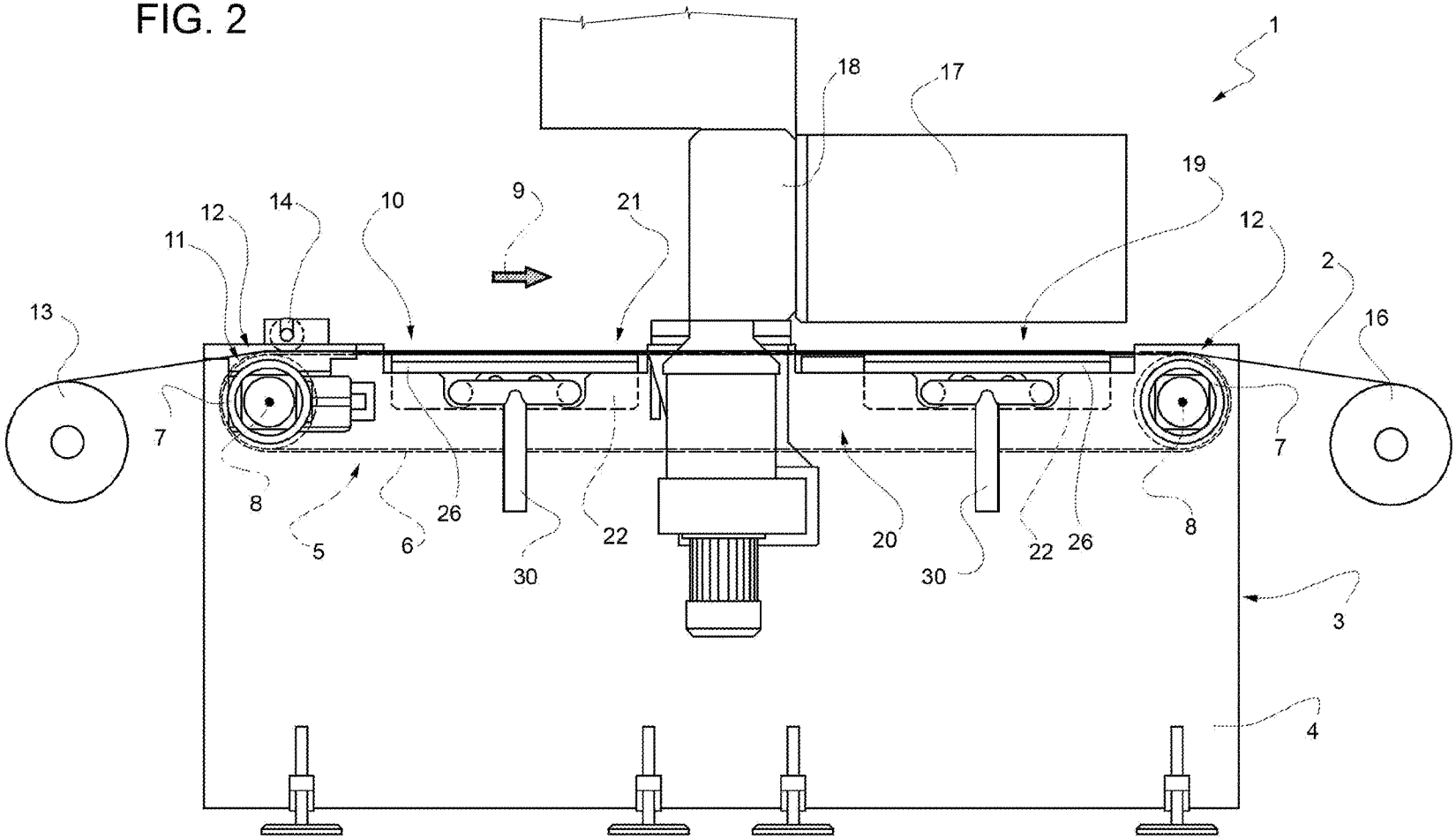
FIG. 2 is a side elevation view, with parts removed for the sake of clarity, of the printer of FIG. 1.

The print substrate 2 may be fed to the printer 1 in the form of a flat sheet or, as in the example illustrated in FIG. 2, in the form of a roll according to the method known as "roll-to-roll", to which the following description specifically refers but without any loss of generality.

As shown in FIG. 1, the inkjet printer 1 comprises a frame 3, which, in turn, comprises two walls 4 facing and parallel to one another and which rest on the floor on specific feet. Between the walls 4 there is a continuous conveyor 5 comprising a belt 6 wound in a loop around two rollers 7, which are mounted on the walls 4 so as to turn about respective axes 8 perpendicular to the walls 4 and define, on the belt 6, a conveying branch, preferably horizontal, movable in a feed direction 9 perpendicular to the axes 8, and a non-conveying return branch arranged below the conveying branch.

As shown in FIGS. 1 and 2, the conveying branch of the continuous conveyor 5 defines a transfer surface 10, the purpose of which is, during use, to carry the print substrate 2 through the printer 1 in the feed direction 9, and which is laterally limited by two longitudinal edges parallel to said feed direction 9, and by two transverse edges 12 perpendicular to the longitudinal edges and defining the axial ends of the continuous conveyor 5.

Specifically, one of the two transverse edges 12 defines, on the transfer surface 10, an input side 11 for the print substrate 2 which, during use, is unwound from a roll 13 mounted on a support element (not illustrated) so as to turn freely about an axis parallel to the axes 8. To ensure that the print substrate 2 fed onto the transfer surface 10 is perfectly flat and that no waves are formed, the input side 11 is provided with a flattening roller 14 to contrast the corresponding roller 7 and which is mounted on the walls 4 so as to turn freely about an axis parallel to the axis 8 in order to define, with the transfer surface 10, a narrow passage suitable to be engaged transversely and in a sliding manner by the print substrate 2.

At the opposite end of the transfer surface 10, the other transverse edge 12 defines, on the transfer surface 10, an output side 15 for the printed substrate 2, which, during use, is rewound onto a motorised roller parallel to the axes 8 so as to form a roll 16.

In addition to the frame 3 and the continuous conveyor 5, the printer 1 further comprises a printing head 17 (known per se), which is slidingly mounted on a rectilinear guide beam 18 to move reciprocate above the transfer surface 10 in a direction perpendicular to the feed direction 9. Specifically, the guide beam 18 is supported by the frame 3, extends from one wall 4 to the other in an intermediate portion of the transfer surface 10 and, on the side facing the output side 15, supports the printing head 17 in a cantilevered fashion. Therefore, during reciprocation, the printing head 17 moves above a transverse portion of the transfer surface 10 which is arranged between the guide beam 18 and the output side 15 and which defines, on said transfer surface 10, a printing station 19.

Lastly, the printer 1 comprises a suction device 20 associated to the continuous conveyor 5 to hold the print support 2 firmly in place on the transfer surface 10 so as to prevent any relative movement between the transfer surface 10 and the print substrate 2 while the latter moves, together with the transfer surface 10, in the feed direction 9.

Suction device 20 may be configured to apply on the print substrate 2 a given suction force at the printing station 19 and at other portions of the transfer surface 10 upstream from, and possibly also downstream of, the printing station 19 in the feed direction 9.

The suction force may be the same on every part of the transfer surface 10 on which suction force is applied or, according to the preferred embodiment shown in the accompanying drawings, it may be variable. Specifically, in this case, the suction device 20 is configured to apply on the substrate 2, through the transfer surface 10, a suction force that is differentiated along the feed direction 9, so that the suction force at the printing station 19 is lower than the suction force upstream from the printing station 19.

In this way, at the printing station 19, where the print substrate 2 is usually less resistant because it is wet with the ink that has just been applied, it is possible to apply on the print substrate 2 a downward force that is sufficient to keep it adhering to the transfer surface 10 but not enough to cause any deformations, such as ripples and depressions, in the structure of the print substrate 2.

On the other hand, at the portion of the transfer surface 10 interposed between the input side 11 and the printing station 19 and hereinafter referred to as the stabilising portion 21, where the print substrate 2 is dry and thus more resistant, the suction device 20 is configured to apply on the print substrate 2 a higher suction force. Furthermore, at the stabilising portion 21, the suction force applied on the print substrate 2 may be uniform or may decrease along the feed direction 9, though always remaining higher than the suction force applied at the printing station 19.

As shown in the accompanying drawings, the suction device 20 is arranged immediately below the transfer surface 10 and the suction force is applied on the print substrate 2 through the belt 6 which, for that purpose, is made of a breathable material, for example a micro-perforated or mesh material.

In the example shown, the suction device 20 comprises two suction tanks 22, which extend crosswise with respect to the feed direction 9, preferably for the entire width of the transfer surface 10, and are arranged one at the printing station 19 and the other at an intermediate area of the stabilising portion 21. The tanks 22 may have the same (as in the example shown) or different sizes in the feed direction 9, but have the same architecture, which will now be described by way of example.

Figure 3:
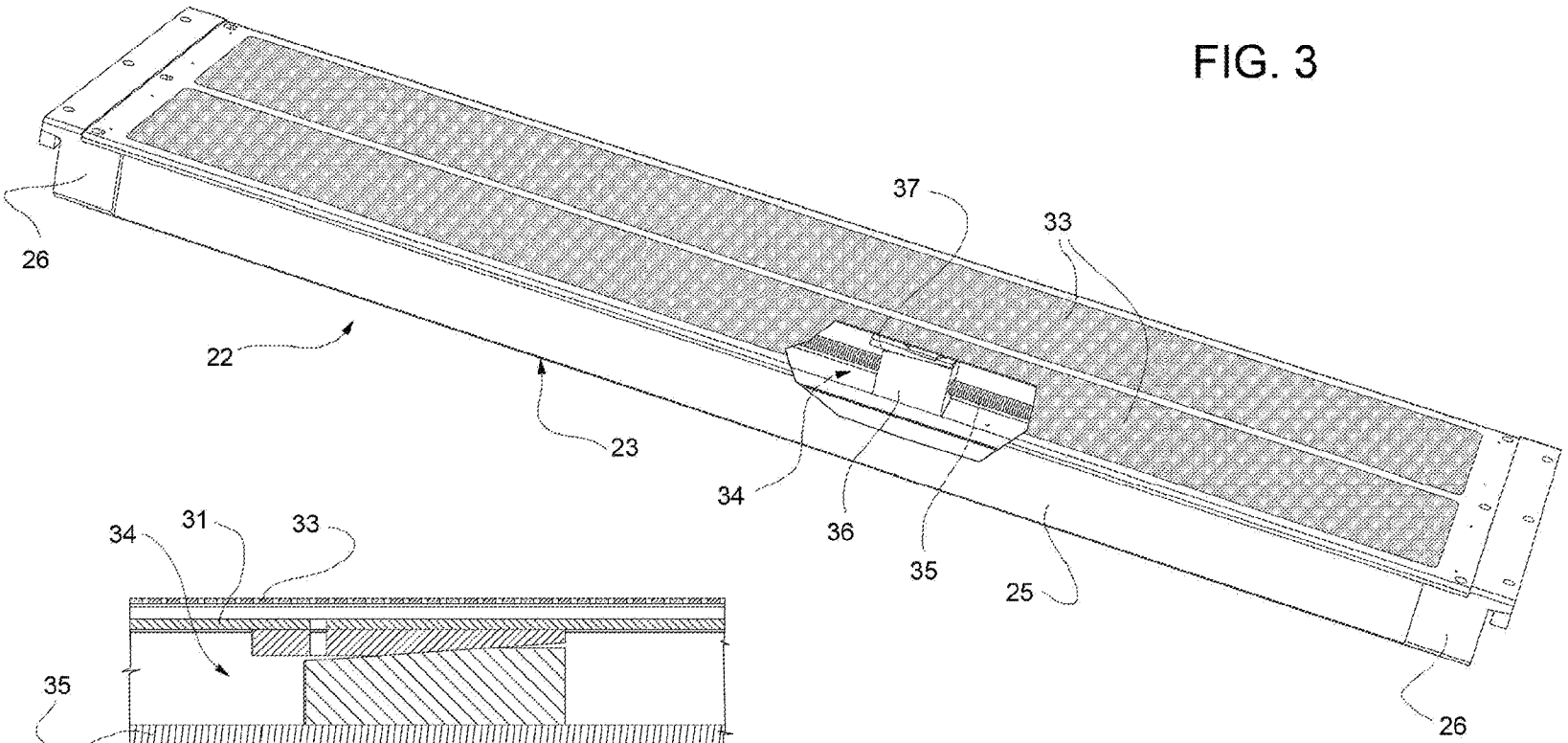
FIG. 3 is a perspective view, with parts removed for the sake of clarity, of a detail of FIG. 1.
Figure 4:
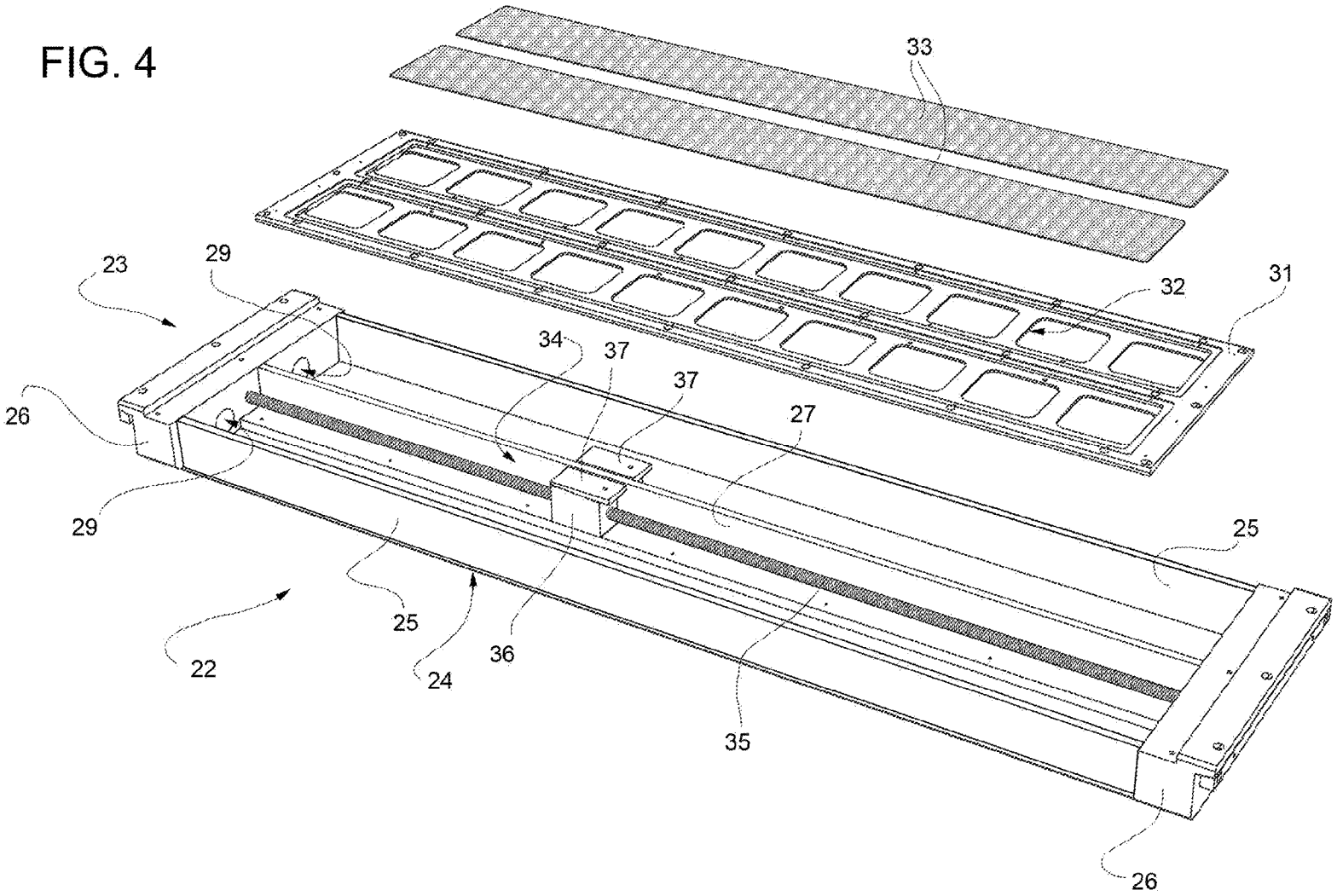
FIG. 4 is an exploded view of the detail of FIG. 3.

As shown in FIGS. 2, 3 and 4, each tank 22 is arranged in the continuous conveyor 5 and comprises a cup-shaped and generically rectangular box structure 23 comprising, in turn, a flat bottom wall 24 parallel to the transfer surface 10, two long side walls 25 perpendicular to the bottom wall 24 and to the feed direction 9, and two short side walls 26, which extend parallel to the feed direction 9 and have respective openings suitable to connect the inside of the tank 22 to an external suction source (not shown).

Each tank 22 further comprises a central partition 27, which is parallel to, and has the same size as, the long side walls 25, and divides the tank 22 into two identical chambers 28, each of which is in communication with the external suction source (not shown) through two respective holes 29 in the short side walls 26.

As shown in FIG. 2, holes 29 in each short side wall 26 are fluidically connected to one another by means of a respective manifold 30 directly connected to the suction source (not shown) and, therefore, the suction forces at the two chambers 28 is the same. Alternatively, the manifold 30 may be replaced with two separate ducts arranged to fluidically connect each chamber 28 to a respective suction source so as to differentiate the suction forces at the two chambers 28, if necessary.

With reference to FIG. 4, the tank 22 is provided at the top with a rectangular grid 31, which is rigidly fixed to the box structure 23 along the long side walls 25 and the short side walls 26, and is provided with a plurality of slots 32, which are relatively large and, preferably, to such an extent as to allow an operator to access the inside of the tank 22 with his/her hands to perform any necessary cleaning or maintenance operations.

Preferably, slots 32 are distributed evenly in the grid 31 in two parallel rows, each of which faces a respective chamber 28 and is covered by a respective perforated plate 33, which is connected, with the interposition of a gasket, to the upper surface of the grid 31 and, as shown in FIG. 2, comes into contact with the lower surface of the transfer surface 10 which slides over it.

According to an alternative embodiment, the two perforated plates 33 may be replaced with a single perforated plate large enough to cover all the slots 32.

Preferably, the perforated plates 33 are detachably connected to the grid 31 so that the inside of the tank 22 can be accessed through the grid 31.

The inkjet printer 1 further comprises an adjustment assembly 39 operable to adjust planarity of the transfer surface 10 and compensate for any depressions. Because the transfer surface 10 may be very large, the suction force could cause the belt 6 and the perforated plates 33 to bend downwards by an amount that, however small, could be enough to reduce efficiency of the suction force and make the print surface uneven, which would have negative consequences in terms of quality of the print.

Should, during use, the planarity of the transfer surface 10 be not appropriate, the adjustment assembly 39 can be used to adjust height of the transfer surface 10 quickly and easily to restore optimal conditions of adherence of the print substrate 2 to the transfer surface 10.

Preferably, the adjustment assembly 39 comprises an adjusting device 34 for each tank 22. According to an alternative embodiment, only some of the tanks 22 may be provided with respective adjusting devices 34 and, in particular, in the case of differentiated suction force, the tank(s) 22 arranged in the stabilising portion 21 where the highest suction force is applied and, therefore, there is a higher risk of the transfer surface 10 bending under the effect of the suction force.

Figure 5:
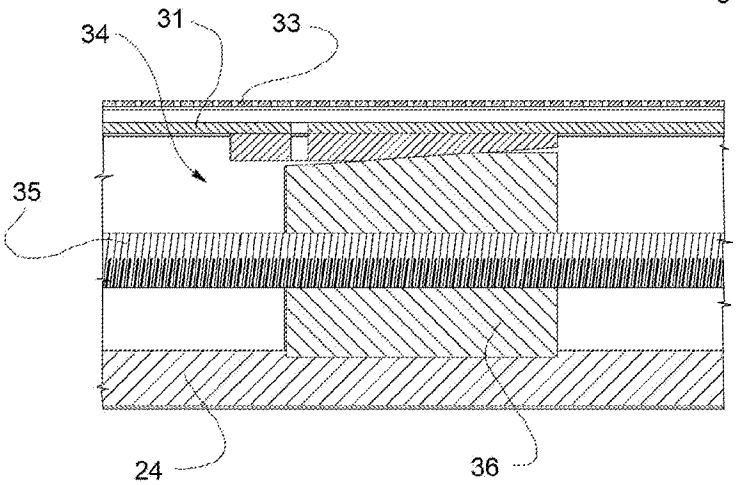
FIG. 5 is a cross-sectional view on an enlarged scale of a detail of FIG. 3.

For that purpose, as shown in FIGS. 3, 4 and 5, adjusting device 34 comprises, for each tank 22, a pair of guide screws 35, each of which extends in a respective chamber 28 orthogonally to the feed direction 9 and is rotatably supported, at its axial ends, by the short side walls 26.

Each guide screw 35 is engaged, at an intermediate portion thereof, by a nut 36 with a thread suitable to transform rotary motion of the guide screw 35 into a linear motion of the nut 36 in a direction perpendicular to the feed direction. Each nut 36 is limited at a top thereof by an inclined surface that is slidingly coupled to the lower inclined surface of a wedge-shaped member 37 rigidly connected to the lower surface of a central portion of the grid 31. Inclination of the surfaces that come into contact with the nut 36 and with the wedge-shaped member 37 is such that, during use, a movement in one direction or the other of the nut 36 along the guide screw 35 due to a rotation of the guide screw 35 results in a vertical upward or downward movement of the wedge-shaped member 37 and, thus, of the transfer surface 10.

One of the two axial ends of each guide screw 35 extends outside of the respective short side wall 26 so that it can be operated manually by an operator or automatically by means of a specific tool (not shown) controlled by an electronic control unit based on electric signals provided by appropriate sensors arranged to measure planarity of the transfer surface 10.

Figure 6:
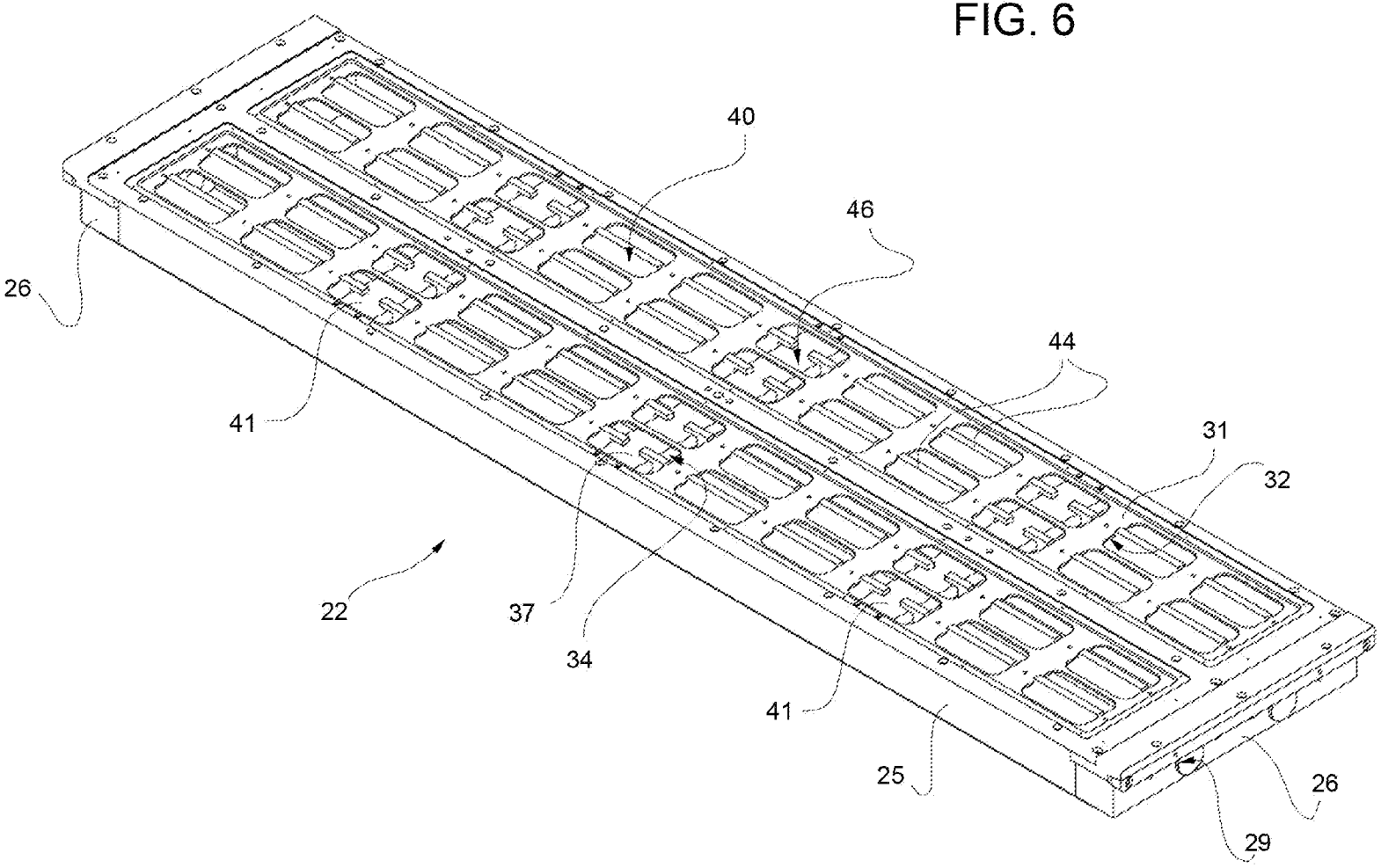
FIG. 6 is a perspective view, with parts removed for the sake of clarity, of a detail of an alternative embodiment of the inkjet printer according to the present invention.
Figure 7:
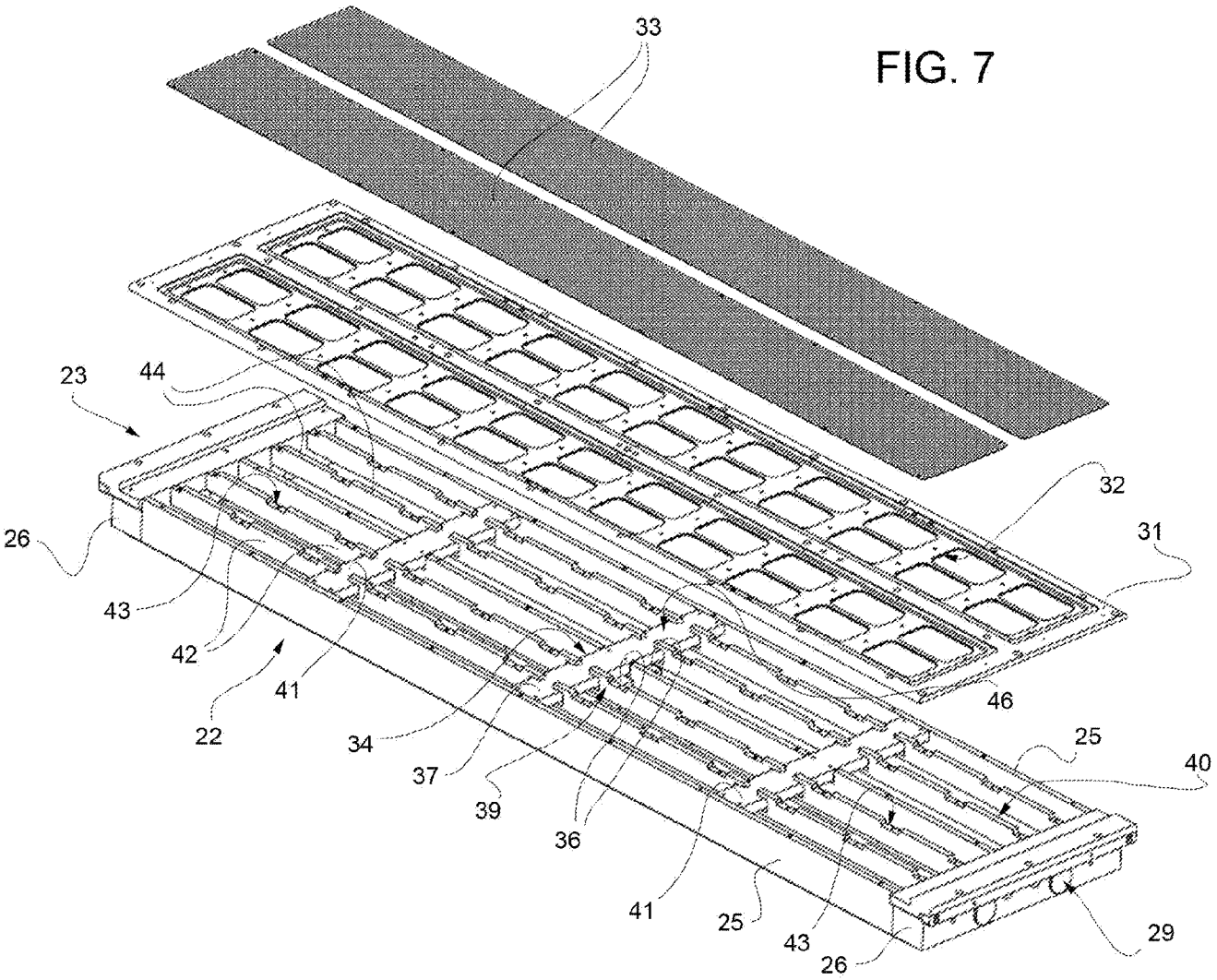
FIG. 7 is an exploded view of the detail of FIG. 6.
Figure 8:
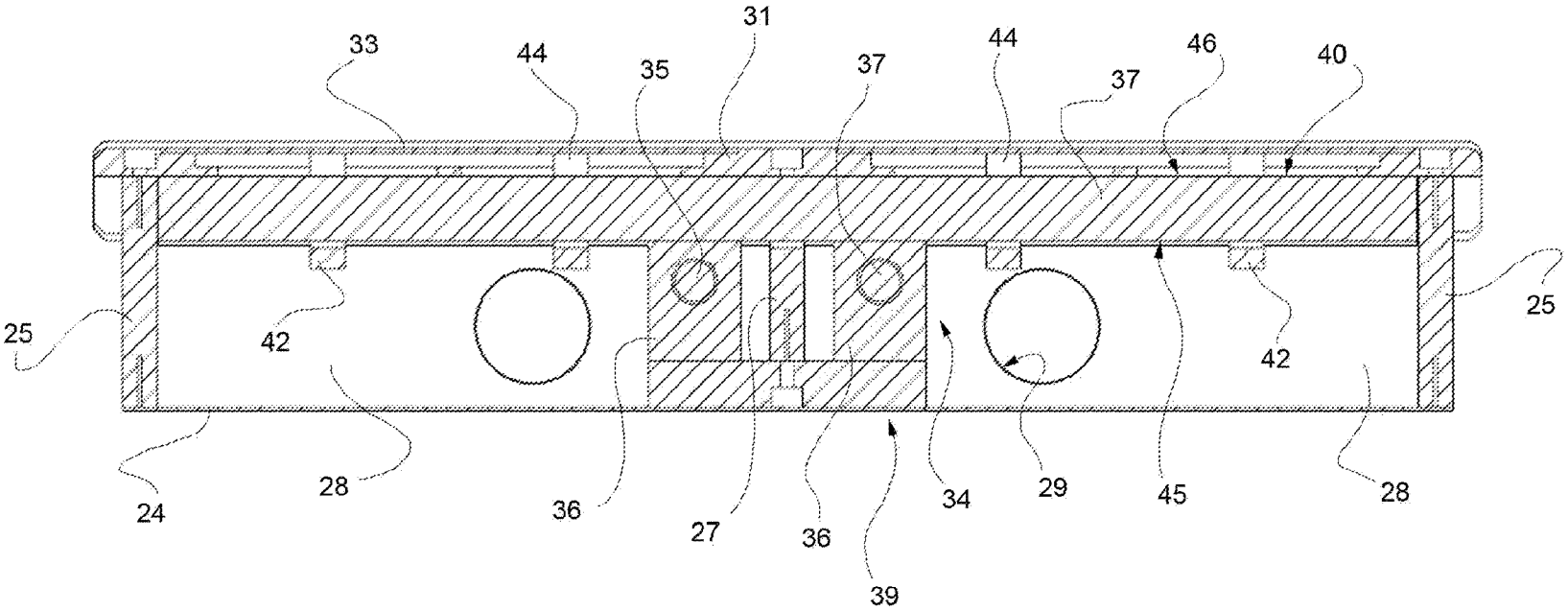
FIG. 8 is a cross-sectional view on an enlarged scale of the detail of FIG. 6.

According to the embodiment shown in FIGS. 6 to 8, tank 22 houses a frame 40 arranged to stiffen the grid 31 and to cooperate with the adjusting device 34 to contrast any bending of the grid 31 and, thus, of the transfer surface 10.

Frame 40 comprises a plurality of cross members 41, which extend between the walls 25 of the tank 22 and are rigidly connected to one another by means of a plurality of longitudinal bars 42, which extend between the walls 26 of the tank 22, are preferably equally distributed between the two chambers 28, and are sized to cause exhausted air to be distributed inside each respective chamber 28.

As shown in FIGS. 6 and 8, each bar 42 is provided on an upper edge thereof with a plurality of recesses 43, which are engaged by respective portions of the grid 31 and define therebetween, along the upper edge of the respective bar 42, a series of ribs 44 protruding inside the slots 32 of the grid 31 and coplanar with the upper surface of the grid 31 on which the plates 33 rest. In this way, the ribs 44 define further supporting points for the plates 33 at the slots 32, namely at the areas in which the suction force could cause a downward deformation of the plates 33.

Furthermore, according to that illustrated in FIG. 8, the cross member 41 arranged in the centre of the tank 22 performs the same function as the wedge-shaped member 37 in the previously-described example (and which hereinafter will be referred to with the same reference numeral).

For that purpose, the cross member 37 is limited at the bottom by an inclined surface 45 slidingly coupled to the upper inclined surface of the nuts 36, and is limited at the top thereof by a flat surface 46 arranged in contact with the grid 31. Possibly, but not necessarily, the cross member 37 may be rigidly connected to the grid 31.

In the same way as described with reference to the previous example, during use, a movement in one direction or the other of the nut 36 along the guide screw 35 due to a rotation thereof results in a vertical upward or downward movement of the cross member 37, which transmits this movement, either directly or through the frame 40, to the grid 31 and, thus to the transfer surface 10.

The functioning of the inkjet printer 1 is apparent from the description provided above and requires no further explanation.

Nonetheless, for the sake of completeness, it is worth noting that not only the width, but also the number of the tanks 22 in the example shown and described is arbitrary and may be varied according to the design and the needs dictated by the structure of the printer 1. Specifically, the tank 22 of the stabilising portion 21 could be replaced with two or more tanks 22 arranged in succession in the feed direction 9 and which may be operated to apply the same suction force on the material or a suction force that decreases from one tank to the next, until reaching a minimum force which is, nonetheless, greater than the suction force in the printing station.

Each tank 22 is connected to a respective motor (not shown) operable to control the suction force independently of the other tank or tanks 22.

As far as the sliding of the transfer surface 10 is concerned, one of the two rollers 7 is a powered roller, while the other is a driven roller, and is controlled to advance the continuous conveyor 5 with a constant sequence of steps of a given size. Alternatively, both rollers 7 may be powered and synchronised with one another.

Lastly, as shown in FIG. 1, the transfer surface 10 may be "masked" depending on the width of the print substrate 2 in order to optimise, as far as possible, suction efficiency of the suction device 20. "Masking" is performed extremely quickly and easily by means of masking plates 38 of an appropriate shape and size, arranged on the transfer surface 10 in the lateral parts of the transfer surface 10 which are not covered, during use, by the print substrate 2. The masking plates 38 are connected by means of a magnetic coupling between said masking plate 38 and a portion of the upper surface of the corresponding short side wall 26.

The invention claimed is:

1. Inkjet printer (1) operable to print a print substrate (2) made of textile, paper or plastic material, or the like; the inkjet printer (1) comprises a sliding transfer surface (10) to feed the print substrate (2) in a feed direction (9); a printing device (17) arranged above the transfer surface (10) to define, on the transfer surface (10), a printing station (19); suction means (20) arranged below the transfer surface (10) to maintain the print substrate (2) adhering to and stationary with respect to the transfer surface (10) during sliding; the inkjet printer (1) is characterised in that it comprises an adjustment unit (39) to adjust planarity of the transfer surface (10), wherein the suction means (20) comprise at least one tank (22) having a suction opening coupled to a lower surface of the transfer surface (10); the adjustment unit (39) comprises at least one adjusting device (34) arranged in the tank (22).

2. Inkjet printer (1) according to claim 1 wherein the suction opening is engaged by a suction plate (31, 33) arranged in contact with the lower surface of the transfer surface (10); the adjusting device (34) is configured to correct any bending of the suction plate (31, 33) that may be caused by the suction.

3. Inkjet printer (1) according to claim 2, wherein the adjusting device (34) comprises wedge means (36, 37) arranged in the tank (22) and operable to move the suction surface (31, 33), together with the transfer surface (10), in a direction perpendicular to the transfer surface (10).

4. Inkjet printer (1) according to claim 3, wherein the wedge means (36, 37) comprise at least a fixed member (37) having an inclined surface, and at least a movable member (36) coupled to the inclined surface of the fixed member (37) so that a movement of the movable member (36) parallel to the transfer surface (10) results in a movement of the fixed member (37), together with the suction plate (31, 33), in a direction perpendicular to the transfer surface (10).

5. Inkjet printer (1) according to claim 4, wherein the movable member (37) comprises a nut engaged by screw means (35).

6. Inkjet printer (1) according to claim 1, wherein a portion of the transfer surface (10) upstream from the printing station (19) defines a stabilising portion (21) for the print substrate (2); the suction means (20) define at least two suction compartments, which are defined by respective tanks (22), one of which is arranged at the printing station (19) and at least other one is arranged at the stabilising portion (21); the adjustment assembly (39) comprises an adjusting device (34) for each tank (22) or at least for the tank (22) arranged at the stabilising portion (21).

7. Inkjet printer (1) according to claim 6, wherein the suction means (20) are configured to differentiate suction in the feed direction (9) to result in the suction at the printing station (19) being lower than the suction at the stabilising portion (21).

8. Inkjet printer (1) according to claim 7, wherein the suction means (20) are configured to independently control suction force at the printing station (19) and at the stabilising portion (21).

9. Inkjet printer (1) according to claim 8, wherein each suction compartment is connected to a respective suction source; and wherein suction force is controlled by adjusting suction power of each suction source.

10. Inkjet printer (1) according to claim 7, wherein the suction means (20) are configured to result, on the stabilising portion (21), in a succession of suction areas with suction forces decreasing in the feed direction (9).

* * * * *